US007717772B2

(12) United States Patent
Fukuda

(10) Patent No.: US 7,717,772 B2
(45) Date of Patent: May 18, 2010

(54) POLISHING TOOL

(75) Inventor: Kenji Fukuda, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 232 days.

(21) Appl. No.: 11/921,105

(22) PCT Filed: May 22, 2006

(86) PCT No.: PCT/JP2006/310122

§ 371 (c)(1),
(2), (4) Date: Nov. 27, 2007

(87) PCT Pub. No.: WO2006/126475

PCT Pub. Date: Nov. 30, 2006

(65) Prior Publication Data

US 2009/0137194 A1 May 28, 2009

(30) Foreign Application Priority Data

May 27, 2005 (JP) ..... 2005-155656

(51) Int. Cl.
*B24B 23/00* (2006.01)

(52) U.S. Cl. ..... 451/344; 451/356

(58) Field of Classification Search ..... 451/344, 451/351, 356, 357

See application file for complete search history.

(56) References Cited

U.S. PATENT DOCUMENTS 4,788,797 A * 12/1988 Kane et al. ..... 451/344

(Continued)

FOREIGN PATENT DOCUMENTS

DE 94 10 754 11/1994

(Continued)

OTHER PUBLICATIONS

Chinese Office Action (along with English language translation) issued Jun. 5, 2009 in the Chinese Application No. 200680018626.9.

(Continued)

*Primary Examiner*—Eileen P. Morgan
(74) *Attorney, Agent, or Firm*—Wenderoth, Lind & Ponack L.L.P.

(57) ABSTRACT

There is provided a polishing tool which enables a polishing surface thereof to be in surface contact with a to-be-polished surface over a wide area of the polishing surface when polishing a corner portion, and which can reduce an impact of a polishing member caused when the polishing member hits against a member around the polishing member. A generally triangular polishing member having apex angles of 60 degrees is connected, through the intermediary of an oscillation transmitting member made of a plate-like spring member, to an oscillating shaft oscillated by a motor. The oscillation transmitting member has a triangular base having at the center thereof a fixing hole by which the triangular base is fitted and fixed to the oscillating shaft, and triangular polishing member holding portions each extending from each side of the triangular base. The polishing member has three polishing pieces each composed of a pad held by the polishing member holding portion and a polishing sheet laminated to the pad. The edge of the polishing piece extends outwardly beyond the edge of the polishing member holding portion.

5 Claims, 1 Drawing Sheet

U.S. PATENT DOCUMENTS

| | | | | | |
|---|---|---|---|---|---|
| 4,905,420 | A | | 3/1990 | Flachenecker et al. | |
| 4,920,702 | A | | 5/1990 | Kloss et al. | |
| 5,054,245 | A | * | 10/1991 | Coty | 451/353 |
| 5,123,216 | A | | 6/1992 | Kloss et al. | |
| 5,437,571 | A | | 8/1995 | Everts et al. | |
| 5,470,272 | A | | 11/1995 | Kikuchi et al. | |
| 5,482,499 | A | | 1/1996 | Satoh | |
| 5,533,925 | A | | 7/1996 | Sato | |
| 5,533,926 | A | * | 7/1996 | Nemazi | 451/490 |
| 5,558,569 | A | * | 9/1996 | Lee | 451/356 |
| 5,597,347 | A | | 1/1997 | Bosten et al. | |
| 5,607,343 | A | * | 3/1997 | Keith et al. | 451/344 |
| 5,626,510 | A | * | 5/1997 | Bergner et al. | 451/357 |
| 5,637,034 | A | * | 6/1997 | Everts et al. | 451/344 |
| 5,709,595 | A | | 1/1998 | Bergner et al. | |
| 5,833,524 | A | * | 11/1998 | Satoh et al. | 451/456 |
| 5,967,886 | A | * | 10/1999 | Wuensch et al. | 451/356 |
| 6,099,397 | A | * | 8/2000 | Wurst | 451/344 |

FOREIGN PATENT DOCUMENTS

| | | |
|---|---|---|
| DE | 195 03 078 | 8/1995 |
| EP | 0 631 843 | 1/1995 |
| GB | 2 232 367 | 12/1990 |
| JP | 146307 | 11/1990 |
| JP | 166207 | 8/1991 |
| JP | 4-115862 | 4/1992 |
| JP | 6-63284 | 9/1994 |
| JP | 2607056 | 2/1996 |
| JP | 9-19860 | 1/1997 |
| JP | 312643 | 8/1997 |
| JP | 330880 | 5/1998 |
| JP | 10-277908 | 10/1998 |
| TW | 146307 | 11/1990 |
| TW | 166207 | 8/1991 |
| TW | 312643 | 8/1997 |
| TW | 330880 | 5/1998 |

OTHER PUBLICATIONS

International Search Report issued Aug. 15, 2006 in the International Application No. PCT/JP2006/310122.

German Office Action issued Sep. 9, 2008 in German Application No. 11 2006 001 374.2-14.

* cited by examiner

[Fig.1]
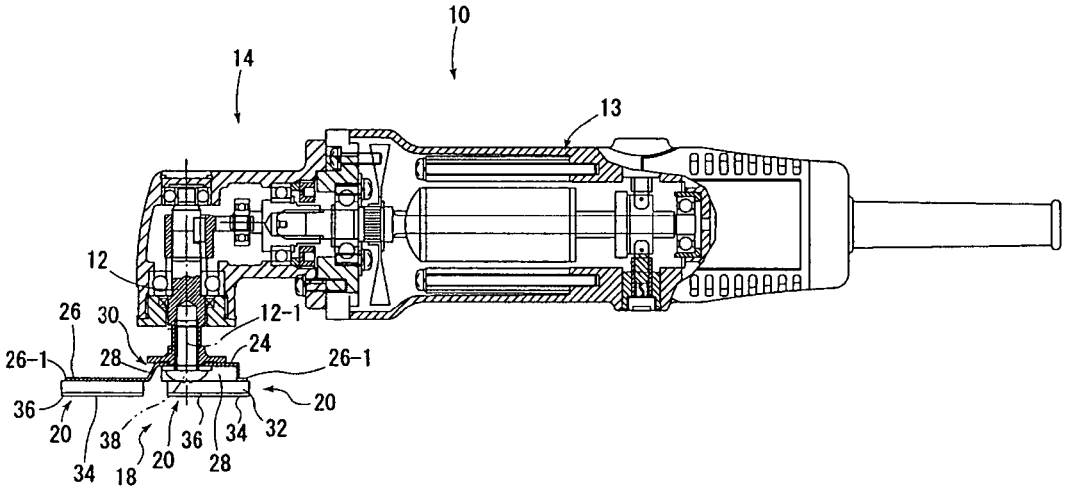
[Fig.2]
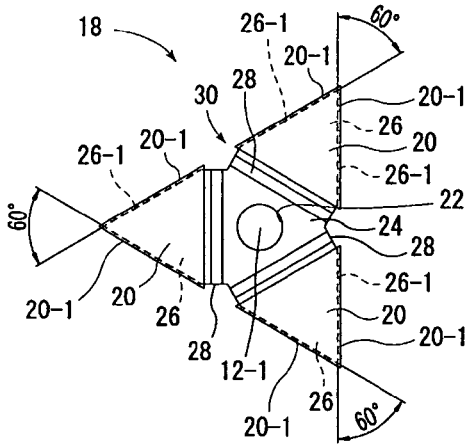

POLISHING TOOL

BACKGROUND OF THE INVENTION

I. Technical Field

The present invention relates to a hand-held polishing tool by which a user performs polishing operation. More particularly, the present invention relates to a polishing tool having an oscillating shaft and a polishing member attached to the oscillating shaft, wherein the oscillating shaft is oscillated by means of a motor within a predetermined angular range about an axis of the shaft, whereby the polishing member performs polishing operation.

II. Description of Related Art

Conventionally, a polishing member used in such a polishing tool is generally thin and triangular in shape so that it is possible to easily polish a surface in a narrow portion such as a corner portion of the inner bottom surface of a box-shaped casing. A surface in such a narrow portion is polished by means of a corner portion of the triangular shape (Japanese Unexamined Utility Model Registration Application Publication No. 6-63284). In this case, a polishing tool body is often inclined such that a polishing surface in the corner portion of the polishing member firmly contacts with a to-be-polished surface in a corner portion and the like, and thus the polishing surface in the corner portion of the polishing member is often urged against the to-be-polished surface. Therefore, the polishing surface in the corner portion of the polishing member wears faster than other portions. Thus, the whole of the polishing member needs to be replaced even though the central portion of the polishing member can still be used, resulting in diseconomy.

Further, Japanese Patent No. 2607056 discloses a polishing tool in which the side portion of the triangular polishing member is arc-shaped in order to prevent the oscillating polishing member from hitting hard against a linearly extending side wall of the above-mentioned casing when polishing the inner bottom surface of the box-shaped casing at a portion adjacent to the side wall in a state in which the side portion of the triangular polishing member is adjacent to the side wall.

SUMMARY OF THE INVENTION

It is an object of the present invention to enable a polishing surface of a polishing member to be in surface contact with a to-be-polished surface in not only the corner portion but also a wide area of the polishing surface even if a user inclines the polishing tool when polishing a surface in the above-described narrow portion.

It is another object of the present invention to reduce an impact of the polishing member caused when the oscillating polishing member hits against the side wall or the like adjacent to the to-be-polished portion.

The present invention provides a polishing tool including an oscillating shaft configured to oscillate about an axis thereof within a predetermined angular range, a plate-shaped polishing member including a polishing surface on one side thereof, and an oscillation transmitting member connecting the polishing member and the oscillating shaft and transmitting oscillation of the oscillating shaft to the polishing member in a state in which the polishing surface is in contact with a surface to be polished. The oscillation transmitting member includes a base secured to the oscillating shaft, and a plate-shaped polishing member holding portions each connected to the base through a connecting portion and extending radially outwardly with respect the oscillating shaft. The polishing member has cushioning properties and an edge portion positioned radially outside a radially outer edge of the polishing member holding portion with respect to the oscillating shaft.

In this polishing tool, the polishing member has the edge portion extending outwardly beyond the radially outer edge of the polishing member holding portion with respect to the oscillating shaft. Therefore, for example, even if the polishing member hits against a side wall of a casing when polishing the bottom surface of the casing, the polishing member absorbs the impact, whereby it is possible to properly perform polishing operation.

In the above polishing tool, since the connecting portions have elasticity, the oscillating shaft can be inclined with respect to the polishing member in a state in which the whole of the polishing surface of the polishing member is in contact with the surface to be polished. Therefore, for example, in order to polish a surface in a narrow portion such as a corner portion of the inner bottom surface of a box-shaped casing, the oscillating shaft can be inclined with respect to the polishing member in a state in which the polishing surface of the polishing member is in surface contact with the to-be-polished surface, whereby it is possible to exerts a large pressure on the polishing surface. Thus, it is possible to efficiently perform polishing operation.

Specifically, the polishing member may have a plate-shaped pad attached to the polishing member holding portion and having a first surface fixed to one surface of the polishing member holding portion and a second surface opposite to the first surface, and a polishing sheet fixed to the second surface of the pad to form the polishing surface.

Preferably, the pad should be made of rubber.

Further, it is preferable that the edge portion of the polishing member positioned radially outside a radially outer edge of the polishing member holding portion with respect to the oscillating shaft have at least one corner having an angle of less than 90 degrees so that it is possible to easily polish a corner portion of a housing and the like.

Specifically, the polishing member may be, as a whole, triangular in shape such that three corners ar e formed on a periphery of the polishing member.

As a specific example, three polishing member holding portions are spaced in an equal angle to each other about the oscillating shaft, and the polishing member is composed of three polishing pieces attached to the polishing member holding portions and arranged so as to form the above-mentioned three corners.

More specifically, a base may be triangular in shape and has three sides and a fixing hole at the center thereof into which the oscillating shaft is securely fitted; the polishing member holding portions each may have a base portion connected to a corresponding one of the three sides of the base through the connecting portion and extend in a triangular shape from the base portion.

Further, a surface of the polishing member on which the polishing surface is provided is apart from the triangular base in an axial direction of the oscillating shaft, and the connecting portion is inclined from a portion connecting with the triangular base toward the polishing member holding portion.

In the polishing tool according to the present invention, even if the polishing member hits against a side wall of a casing when polishing the bottom surface of the casing, for example, the polishing member absorbs the impact, whereby it is possible to properly perform polishing operation. Further, the connecting portion has elasticity. Therefore, for example, in order to polish a surface in a narrow portion such as a corner portion of the inner bottom surface of a box-shaped casing, the oscillating shaft can be inclined with respect to the polishing member in a state in which the polishing surface of the polishing member is in surface contact with the to-be-polished surface, whereby it is possible to exerts a large pressure on the polishing surface. Thus, it is possible to efficiently perform polishing operation.

BRIEF DESCRIPTION OF THE DRAWINGS

FIG. 1 is a partially sectional view showing a body of a polishing tool and a state in which a polishing member is fitted and fixed to an oscillating shaft of the body.

FIG. 2 is a plan view of the polishing member.

DETAILED DESCRIPTION OF THE INVENTION

An embodiment of a polishing tool according to the present invention will now be described with reference to the accompanying drawings.

A polishing tool 10 according to the present invention has an oscillating shaft 12, a body 14 having a motor 13 for oscillating the oscillating shaft 12, and a polishing member 18 attached to the oscillating shaft 12.

The polishing member 18 has a generally triangular shape in which each apex angle is 60 degrees (FIG. 2). Three polishing pieces 20 are arranged about an axis 12-1 of the oscillating shaft 12 at a constant interval so as to form the apexes.

The polishing pieces 20 are attached to an oscillation transmitting member 30 made of a generally triangular plate-like spring member which is secured to the oscillating shaft 12. The oscillation transmitting member 30 has a triangular base 24 having at the center thereof a fixing hole 22 into which the oscillating shaft 12 is fitted and fixed, triangular polishing member holding portions 26 each extending from each side of the triangular base 24, and connecting portions 28 elastically connecting the polishing member holding portions 26 and the triangular base 24. The connecting portion 28 is inclined from a portion connecting with the triangular base 24 toward the polishing member holding portion 26 such that the polishing member holding portion 26 is positioned apart from the triangular base 24 in an axial direction of the oscillating shaft 12. The polishing pieces 20 are each composed of a thin plate-like cushion member, i.e. a pad 32, attached to the polishing member holding portion 26, and a polishing sheet 36 detachably attached to the pad 32 by means of removable adhesive or the like and forming the polishing surface 34 of the polishing member 18. As shown in the figure, each polishing piece 20 has an edge portion 20-1 extending radially outwardly beyond the radially outer edge 26-1 of the polishing member holding portion 26 with respect to the oscillating shaft 12. The pad 32 is made of a cushioning material such as rubber, soft synthetic resin, or the like. The polishing piece 20 is not necessarily composed of the pad 32 and the polishing sheet 36. For example, the polishing piece may be made of a cushioning material such as rubber, and then abrasive may be mixed in one surface of the polishing piece to form a polishing surface.

The oscillation transmitting member 30 is formed such that the oscillating shaft 12 can be inclined with respect to one polishing piece 20 and oscillation of the oscillating shaft is transmitted to the polishing member 18 in a state in which the polishing piece 20 is in surface contact with the to-be-polished surface.

In the illustrated example, the polishing member 18 is arranged such that one polishing piece 20 is disposed with projecting forward (leftward in FIG. 1) from the tool body 14, while the other two polishing pieces 20 are disposed rearward of the one polishing piece 20 on both sides of the tool body 14. When the wear amount of the one polishing piece 20 reaches or exceeds a predetermined amount, a fixing bolt 38 is loosened to rotate the polishing member 18 by 120 degrees about the oscillating shaft and then tightened to fix the polishing member 18, which allows continuous use of the polishing member 18. Further, particle sizes of the three polishing pieces 20 may differ from each other in order to enable polishing operation from rough finishing to fine finishing by rotating the polishing member 18 about the oscillating shaft.

In polishing operation, a user grasps the body 14 of the polishing tool 10. When polishing, for example, a narrow portion such as a corner portion of the inner bottom surface of a box-shaped casing, the user urges the polishing piece 20 which is positioned forward of the body 14 against the narrow portion. In this case, even if the user inclines the polishing tool body, it is possible to perform polishing operation in a state in which the polishing surface 34 is kept in surface contact with the to-be-polished surface by means of the connecting portions 28 of the oscillation transmitting member 30 made of a spring member. Therefore, it is possible to prevent partial wear of the polishing sheet 36 forming the polishing surface 34 as well as to perform efficient polishing operation.

Further, the polishing piece 20 having cushioning properties has an edge portion 20-1 extending radially outwardly beyond the radially outer edge 26-1 of the polishing member holding portion 26 with respect to the oscillating shaft 12. Therefore, even if the polishing piece 20 hits against a side wall around the to-be-polished surface in polishing operation, it is possible to absorb the impact to smoothly continue polishing operation.

The invention claimed is:

1. A polishing tool comprising:

an oscillating shaft configured to oscillate about an axis thereof within a predetermined angular range and having a lower end;

three triangular plate-shaped polishing members, including first, second and third triangular plate-shaped polishing members, each triangular plate-shaped polishing member having a lower surface serving as a polishing surface; and, an oscillation transmitting member including a triangular base having first, second and third sides and a fixing hole at a center of the triangular base into which the oscillating shaft is fitted, and three polishing member holding portions, including first, second and third polishing member holding portions, each polishing member holding portion having a base portion, the base portion for the first, second and third polishing member holding portions being respectively connected to the first, second and third sides of the three sides of the base through a connecting portion, and each polishing member holding portion extending in a triangular shape from the base portion toward an apex with two sides of each of the polishing member holding members extending from opposite ends of the base portion to the apex, wherein each connecting portion extends from a respective side of the base, axially away from and radially outward relative to the oscillation shaft so that the polishing member holding portions are position axially apart from the base and positioned in a plane normal to an axial direction of the oscillation shaft, wherein the first, second and third polishing member holding portions have first, second and third lower sides, respectively, on which the first, second and third triangular polishing members are attached, respectively, and each triangular polishing member has two sides thereof extending parallel with and outside sides of the polishing member holding portion to which the triangular polishing member is attached, wherein the oscillation transmitting member is formed from a sheet-shaped spring member so that the oscillation shaft is capable of being inclined relative to one of the polishing members and the polishing surface of the one of the polishing members to which the oscillation shaft is inclined maintains surface contact with a surface to be polished; and wherein each polishing member has cushioning properties and an edge portion positioned radially outside a radially outer edge of the polishing member holding portion with respect to the oscillating shaft.

2. A polishing tool according to claim 1, wherein each polishing member of the polishing members includes a plate-shaped pad with a lower surface, and for each polishing member, the plate-shaped pad is attached to the lower side of the polishing member holding portion, and a polishing sheet is fixed to the lower surface of the plate-shaped pad to form the polishing surface.

3. A polishing tool according to claim 2, wherein the plate-shaped pad is made of rubber.

4. A polishing tool according to claim 1, wherein the sides of each triangular polishing member of the triangular polishing members defines an angle of less than 90 degrees at the apex.

5. A polishing tool according to claim 1, wherein three polishing member holding portions are spaced in an equal angle to each other about the oscillating shaft.

* * * * *